US009531139B2

(12) United States Patent
Morita

(10) Patent No.: US 9,531,139 B2
(45) Date of Patent: Dec. 27, 2016

(54) CONNECTOR AND CONNECTOR CONNECTION STRUCTURE

(71) Applicants: Furukawa Electric Co., Ltd., Tokyo (JP); Furukawa Automotive Systems, Inc., Inukami-gun (JP)

(72) Inventor: Haruki Morita, Tokyo (JP)

(73) Assignees: Furukawa Electric Co., Ltd., Tokyo (JP); Furukawa Automotive Systems, Inc., Inukami-gun (JP)

( * ) Notice: Subject to any disclaimer, the term of this patent is extended or adjusted under 35 U.S.C. 154(b) by 0 days.

(21) Appl. No.: 14/594,865

(22) Filed: Jan. 12, 2015

(65) Prior Publication Data

US 2015/0126056 A1 May 7, 2015

Related U.S. Application Data

(63) Continuation of application No. PCT/JP2013/069218, filed on Jul. 12, 2013.

(30) Foreign Application Priority Data

Jul. 12, 2012 (JP) ..... 2012-156160

(51) Int. Cl.
*H01R 13/40* (2006.01)
*H01R 24/28* (2011.01)
(Continued)

(52) U.S. Cl.
CPC ..... *H01R 24/28* (2013.01); *H01R 13/521* (2013.01); *H01R 9/032* (2013.01); *H01R 13/506* (2013.01);
(Continued)

(58) Field of Classification Search
CPC . H01R 13/405; H01R 13/521; H01R 13/5221; H01R 13/5208; H01R 43/24
(Continued)

(56) References Cited

U.S. PATENT DOCUMENTS 5,518,415 A * 5/1996 Sano ..... H01R 13/521 439/204
5,637,007 A * 6/1997 Suzuki ..... H01R 13/5216 439/276
(Continued)

FOREIGN PATENT DOCUMENTS

CN 101764310 A 6/2010
CN 102365791 A 2/2012
(Continued)

OTHER PUBLICATIONS

International Search Report Issued on Aug. 20, 2013 for PCT/JP2013/069218 Filed on Jul. 12, 2013 (English Language).
(Continued)

*Primary Examiner* — Hien Vu
(74) *Attorney, Agent, or Firm* — Oblon, McClelland, Maier & Neustadt, L.L.P.

(57) ABSTRACT

A connector includes a metal terminal part on which conductive wires exposed outside at an end of an electric cable are pressure-contacted; and a housing for accommodating a pressure-contact part A of the end of the electric cable and the metal terminal part. The housing 10 has an electric cable insertion hole, a wall of which is contactable with an outer circumferential surface of an insulating cover of the electric cable. The housing also has a filling space in communication with the electric cable insertion hole. The filling space is located in positional correspondence with the pressure-contact part A; and the filling space is filled with a filler such that the filler covers the pressure-contact part A.

2 Claims, 10 Drawing Sheets

(51) Int. Cl.

| | |
|---|---|
| ***H01R 13/52*** | (2006.01) |
| *H01R 13/622* | (2006.01) |
| *H01R 13/658* | (2011.01) |
| *H01R 105/00* | (2006.01) |
| *H01R 9/03* | (2006.01) |
| *H01R 13/506* | (2006.01) |

(52) U.S. Cl.
CPC ..... *H01R 13/5202* (2013.01); *H01R 13/622* (2013.01); *H01R 13/658* (2013.01); *H01R 2105/00* (2013.01); *H01R 2201/26* (2013.01)

(58) Field of Classification Search
USPC ..... 439/587, 276, 736, 936
See application file for complete search history.

(56) References Cited

U.S. PATENT DOCUMENTS

| | | | | |
|---|---|---|---|---|
| 6,344,612 | B1 | 2/2002 | Kuwahara et al. | |
| 7,175,481 | B1 | 2/2007 | Cotton et al. | |
| RE41,182 | E | 3/2010 | Cotton et al. | |
| 7,723,619 | B2 * | 5/2010 | Ohashi | B29C 45/0025 174/260 |
| 9,033,747 | B2 * | 5/2015 | Sato | H01R 13/5202 439/736 |
| 2006/0063412 | A1 | 3/2006 | Matsumoto et al. | |
| 2009/0258521 | A1 | 10/2009 | Ooki | |
| 2013/0065430 | A1 | 3/2013 | Adachi et al. | |

FOREIGN PATENT DOCUMENTS

| | | | |
|---|---|---|---|
| EP | 0 999 601 | A1 | 5/2000 |
| JP | 55-140272 | U | 10/1980 |
| JP | 61-107165 | U | 7/1986 |
| JP | 10-21982 | A | 1/1998 |
| JP | 2000-223206 | A | 8/2000 |
| JP | 2002-289293 | A | 10/2002 |
| JP | 2003-109702 | A | 4/2003 |
| JP | 2010-153143 | A | 7/2010 |
| WO | WO 2011/037269 | A1 | 3/2011 |
| WO | WO 2011/132643 | A1 | 10/2011 |

OTHER PUBLICATIONS

Extended European Search Report issued Feb. 17, 2016 in Patent Application No. 13816896.8.
Combined Chinese Office Action and Search Report issued Nov. 4, 2015 in Patent Application No. 201380006668.0 (with English language translation).
Office Action issued Jun. 24, 2016 in Chinese Patent Application No. 201380006668.0 (with English language translation).

* cited by examiner

CONNECTOR AND CONNECTOR CONNECTION STRUCTURE

CROSS-REFERENCE TO RELATED APPLICATIONS

This application is a continuation application of PCT International Application No. PCT/JP2013/069218 filed Jul. 12, 2013, which claims priority to Japanese Application No. 2012-156160 filed Jul. 12, 2012, both of which are herein incorporated by reference in their entirety for all purposes.

TECHNICAL FIELD

The present invention relates to a connector having a simplified structure, and a connector connection structure including the same.

BACKGROUND ART

Conventionally known connectors, for connecting an electric cable for supplying electricity of a large current and a high voltage to an input/output terminal of an electric device such as a motor mounted on an electric vehicle or the like, are water-proof and oil-proof and shield electromagnetic waves in order to protect electronic components in the vicinity thereof against electromagnetic noise released by the electric cable.

Recently proposed connectors have a metal terminal part, an end of the electric cable and a connector housing thereof molded integrally to be enhanced in water-proofness and oil-proofness. However, it requires large facilities to actually mold the metal terminal part, the end of the electric cable and the connector housing, which raises the production cost of the connectors.

Patent Document 1 proposes a connector production method which does not use molding. According to this method, a filling space which is to be filled with a filler is formed at a position where the end of the electric cable and the metal terminal part are to be pressure-contacted on each other. The filling space is filled with the filler to enhance the water-proofness and the oil-proofness.

However, the connector produced by the method proposed by Patent Document 1 has a special structure for restricting the position of a pressure-contact part where the end of the electric cable and the metal terminal part are pressure-contacted on each other, in order to fill the filling space with the filler. In more detail, an end of the connector on the side of the electric cable and the metal terminal part is provided with a stabilizer (engaging member) and a rubber plug, whereas the housing includes a lance engageable with, and stoppable by, the stabilizer. This complicates the structure of the connector.

CITATION LIST

Patent Literature

Patent Document 1: Japanese Laid-Open Patent Publication No. 2000-223206

SUMMARY OF INVENTION

Technical Problem

The present invention has an object of providing a connector having a simplified structure, and a connector connection structure including the same.

Solution to Problem

The present invention is directed to a connector for connecting an electric cable to an electric device having an insertion opening provided for electric cable connection. The includes a metal terminal part on which conductive wires exposed outside at an end of the electric cable are pressure-contacted; and a housing for accommodating a pressure-contact part of the end of the electric cable and the metal terminal part. The housing has an electric cable insertion hole, a wall of which is contactable with an outer circumferential surface of an insulating cover of the electric cable. The housing also has a filling space in communication with the electric cable insertion hole. The filling space is located in positional correspondence with the pressure-contact part; and the filling space is filled with a filler such that the filler covers the pressure-contact part. The present invention is also directed to a connector connection structure including a connector having the above-described structure; and an insertion opening of an electric device. The connector is inserted into the insertion opening to connect the electric device and the electric cable(s) to each other.

According to the above, the structure of the connector can be simplified.

This will be described in more detail. Since the filling space accommodating the pressure-contact part is filled with the filler, the pressure-contact part is covered with certainty with no use of any molding method. In addition, the electric cable insertion holes are put into contact with the outer circumferential surfaces of the insulating covers of the electric cables, and the electric cables are in contact with the walls of the electric cable insertion holes with substantially no gap. This restricts the position of the electric cable inserted into the electric cable insertion hole, and thus restricts the position of the pressure-contact part in the filling space. In this case, the position of the pressure-contact part is restricted with no need of any special component. This simplifies the structure of the connector.

In an embodiment of the present invention, the pressure-contact part may have a width larger than that of the electric cable; the filling space may have a width which corresponds to that of the pressure-contact part and is larger than that of the electric cable; and a step may be formed between the electric cable insertion hole and the filling space, the step corresponding to a difference between the width of the electric cable and the width of the pressure-contact part.

According to the above, the step, formed because of the width difference between the electric cable and the pressure-contact part, is usable to determine the position of the pressure-contact part in the direction in which the electric cable is insertable, with no need of any special component. Therefore, the position of the pressure-contact part in the filling space is restricted with more certainty while the structure of the connector is simplified.

In an embodiment of the present invention, the housing may include a plurality of the electric cable insertion holes for allowing a plurality of the electric cables to be inserted thereinto; and the housing may also have a plurality of the filling spaces which correspond to the electric cable insertion holes and are separate from each other.

According to the above, the pressure-contact parts are covered with the filler with certainty.

This will be described in more detail. For example, it is conceivable to form one common filling space for accommodating the plurality of pressure-contact parts. However, such a filling space has a complicated and enlarged structure, and thus involves an undesirable possibility that air bubbles are formed in a part of the filling space during the work of filling the filling space with the filler. By contrast, in the above-described structure in which the filling spaces are formed separately in correspondence with the electric cable insertion holes, each filling space is simplified in shape and decreased in capacity. Therefore, the pressure-contact parts are covered with the filler with certainty with no air bubble being formed in the filling spaces.

Advantageous Effects of Invention

The present invention provides a connector having a simplified structure, and a connector connection structure including the same.

DESCRIPTION OF EMBODIMENTS

Hereinafter, an embodiment of the present invention will be described with reference to the drawings.

Figure 1:
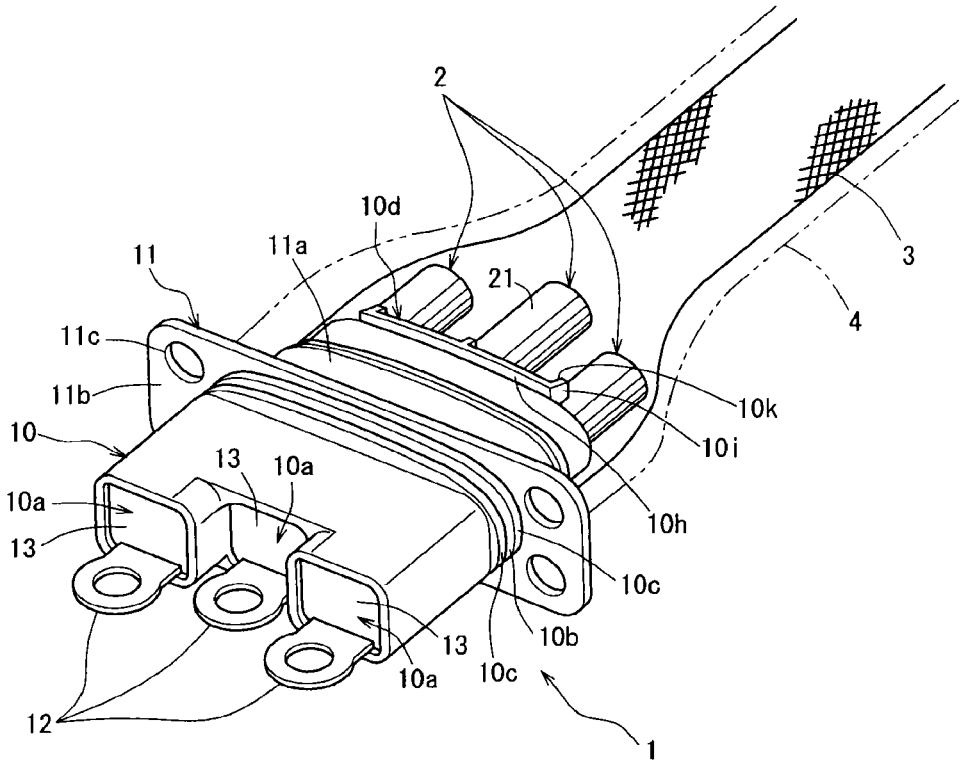
FIG. 1 is an isometric view of a connector in an embodiment according to the present invention as seen from one of two ends thereof.
Figure 2:
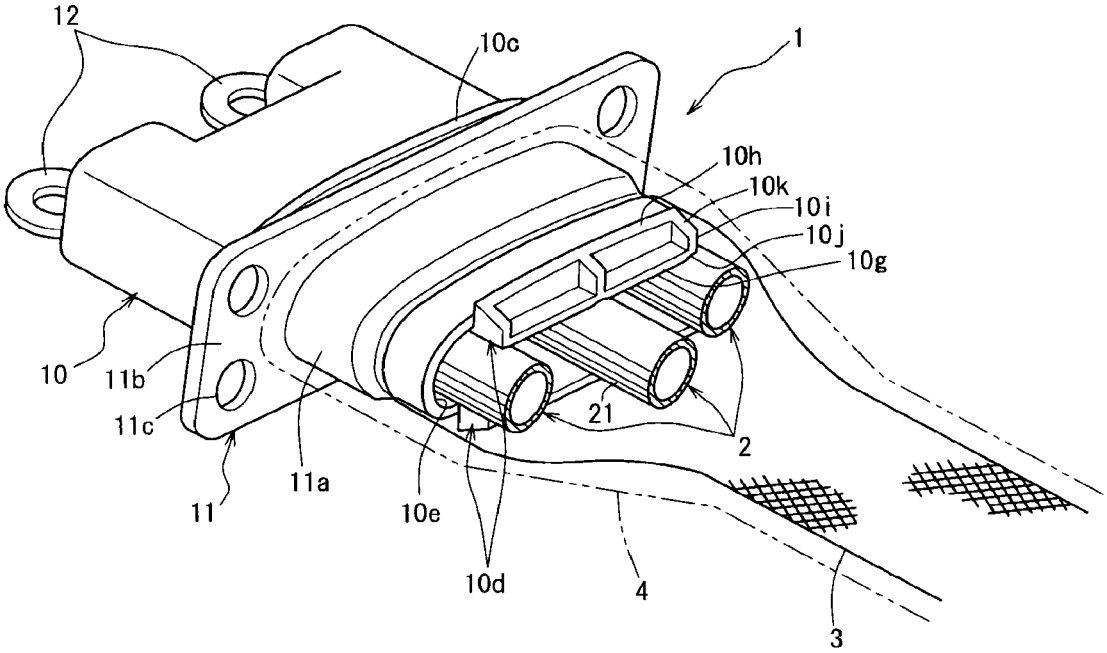
FIG. 2 is an isometric view of the connector as seen from the other end thereof.
Figure 3:
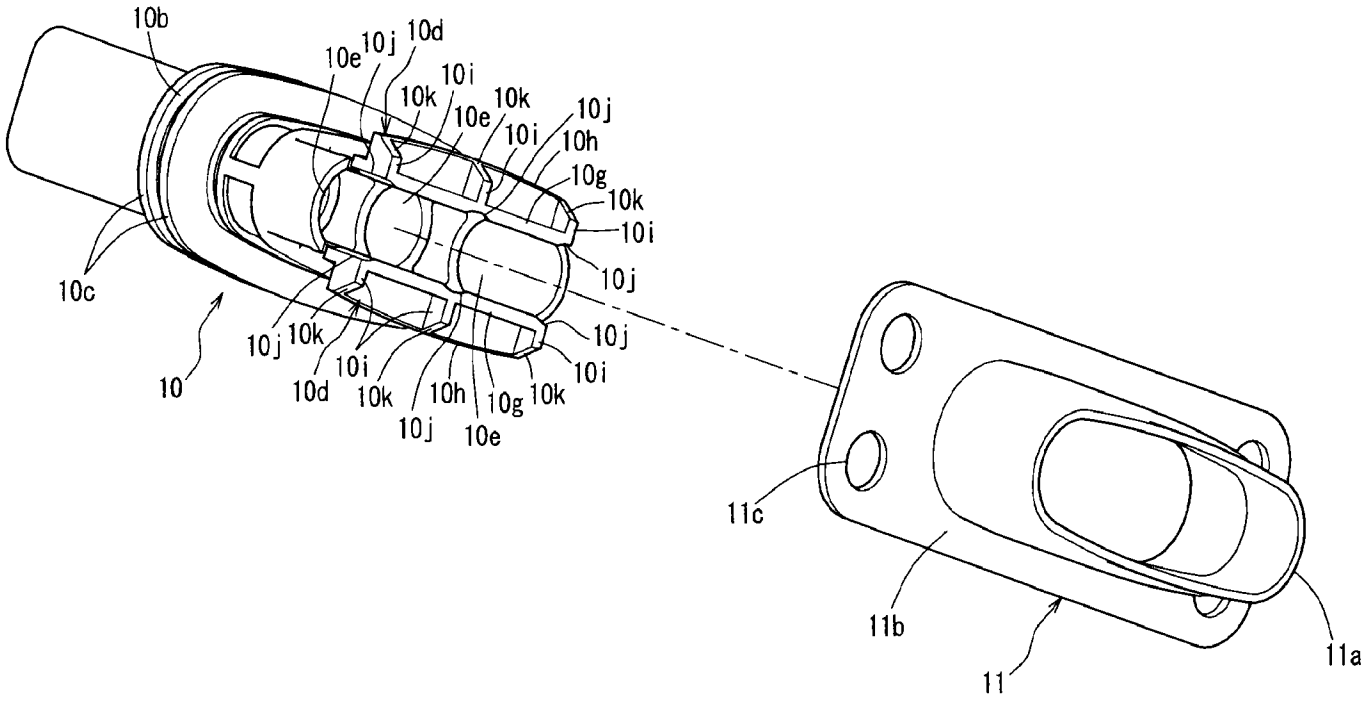
FIG. 3 is an exploded isometric view of the connector that shows a housing and a metal cover.
Figure 4:
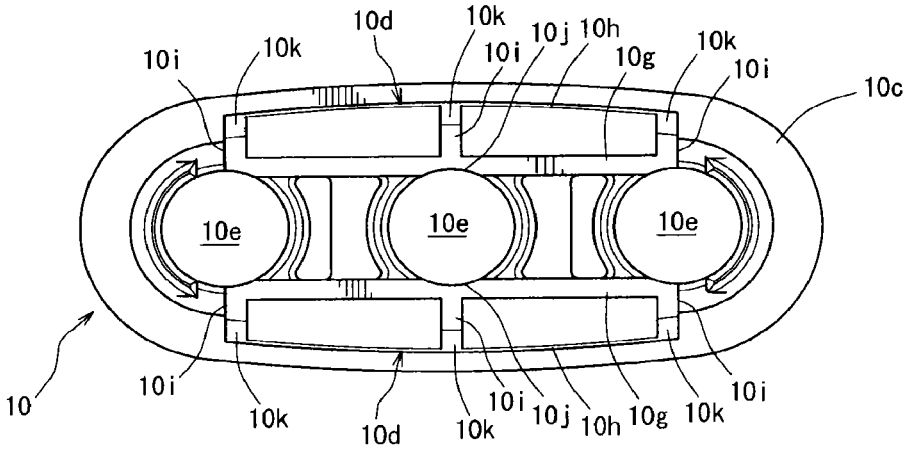
FIG. 4 is a rear view of the housing, which is a view as seen from the other end of the connector.
Figure 5:
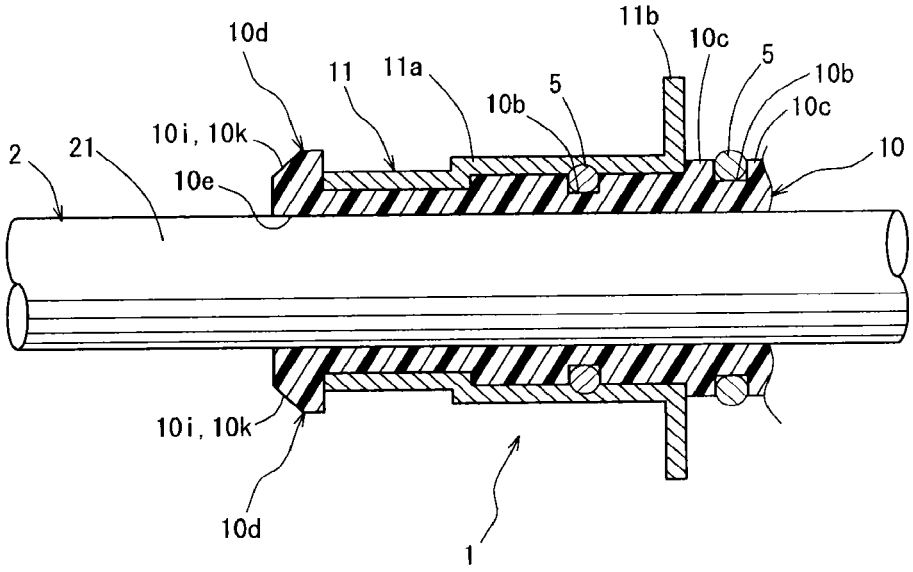
FIG. 5 is a vertical cross-sectional view of the connector.
Figure 6:
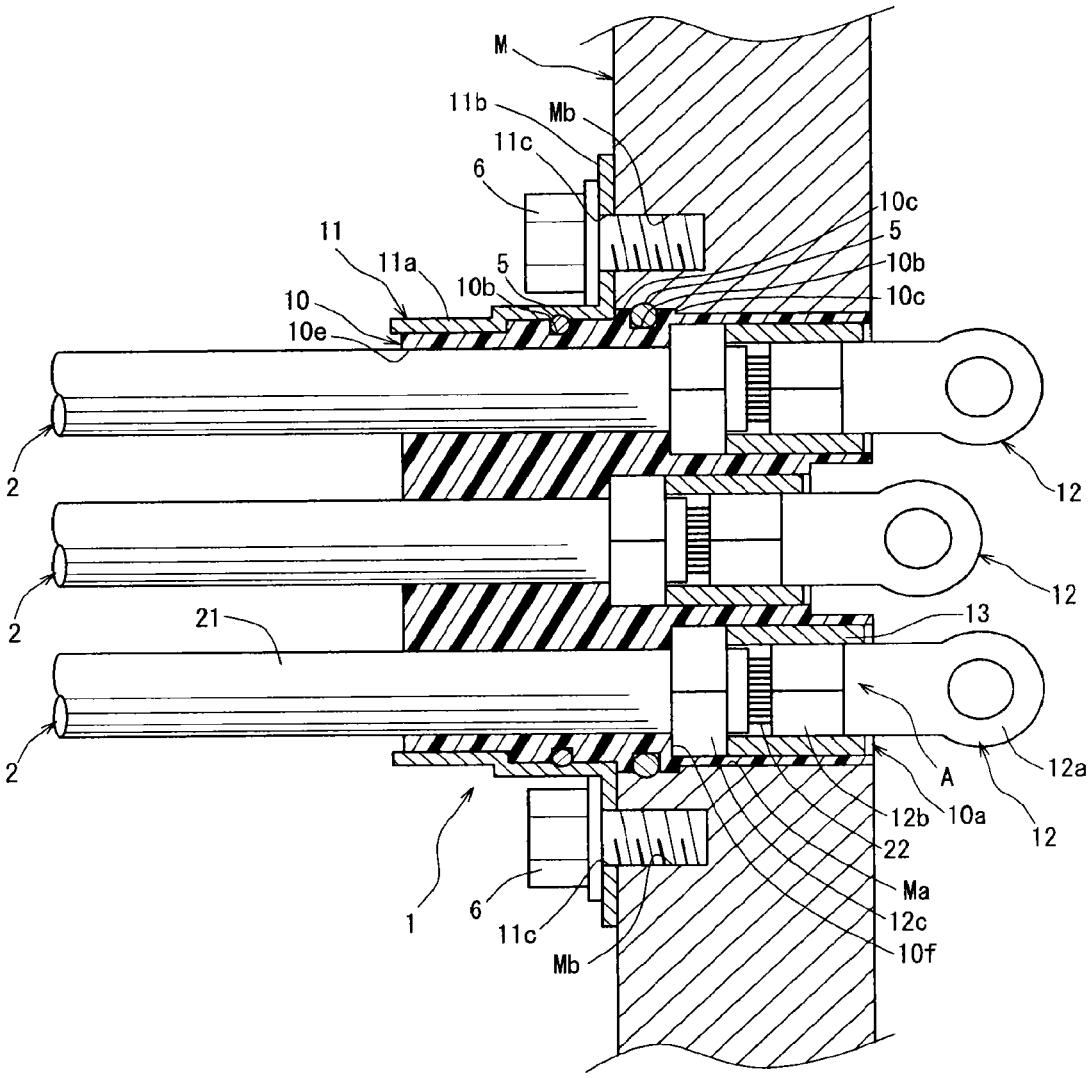
FIG. 6 is a horizontal cross-sectional view of the connector.

FIG. 1 is an isometric view of a connector 1 as seen from one of two ends thereof, and FIG. 2 is an isometric view of the connector 1 as seen from the other end thereof. FIG. 3 is an exploded isometric view of the connector 1 that shows a housing 10 and a metal cover 11. FIG. 4 is a rear view of the housing 10, which is a view as seen from the other end of the connector 1. FIG. 5 is a vertical cross-sectional view of the connector 1, and FIG. 6 is a horizontal cross-sectional view thereof. FIGS. 7A-7B and FIGS. 8A-8B show how to assemble the connector 1 and connect electric cables 2 to the connector 1. In this specification, the end of various components of the connector 1 on the side of metal terminal parts 12 is defined as the "one end". The opposite end, namely, the end of various components of the connector 1 on the side of the electric cables 2 is defined as the "other end". In FIG. 1 and FIG. 2, a boot 4 is shown as being transparent with two-dot chain line for the sake of convenience.

As shown in FIG. 1 through FIG. 6, the connector 1 includes the housing 10 which is formed of a resin and is flexible, the metal cover 11 which is tube-like and covers the housing 10, the plurality of (herein, three) metal terminal parts 12 exposed outside from one end of the housing 10, and a filler 13 provided to fill a plurality of (herein, three) filling spaces 10*a* formed at the one end of the housing 10. The filling spaces 10*a* correspond to the plurality of metal terminal parts 12 and are separate from each other.

As shown in FIG. 1, FIG. 2, FIG. 5 and FIG. 6, a plurality of (herein, three) the electric cables 2 are connected to the connector 1. As described later, each of the electric cables 2 has an end thereof pressure-contacted on the corresponding metal terminal part 12 of the connector 1. Outside the connector 1, as shown in FIG. 1 and FIG. 2, the electric cables 2 are covered with a shield braid 3 and the boot 4. The shield braid 3 is formed by braiding raw metal lines or metal-plated resin lines into a tube shape. The boot 4 is formed of a resin and is shown with the two-dot chain line in the figures. In FIG. 3 through FIG. 6, the shield braid 3 and the boot 4 are omitted for the sake of convenience.

The shield braid 3 is an electromagnetic shield member for absorbing electromagnetic waves emitted from the electric cables 2 when, for example, the electric cables 2 are provided for supplying electricity of a large current and a high voltage. The shield braid 3 prevents the electromagnetic waves from being released outside.

The shield braid 3 has an end thereof located on an outer wall of the metal cover 11 and is fixed to the metal cover 11 by a prescribed, generally ring-shaped fixing member (not shown) formed in correspondence with the shape of the metal cover 11. The boot 4 is fixed to the metal cover 11 by a prescribed band member (not shown). The boot 4 covers the ends of the electric cables 2, the metal cover 11 and the shield braid 3.

Among the components of the connector 1, the housing 10 has the plurality of filling spaces 10*a* at the one end thereof. As shown in FIG. 5 and FIG. 6, the housing 10 also has grooves 10*b*, convexed parts 10, and a pair of engageable claws 10*d* at an outer wall thereof. Into the grooves 10*b*, O-rings 5 can be fit. The convexed parts 10*c* sandwich and form the grooves 10*b*. The pair of engageable claws 10*d* are provided to hold the electric cables 2 therebetween.

As shown in FIG. 3 through FIG. 6, the housing 10 has a plurality of (herein, three) electric cable insertion holes 10*e* therein in numerical correspondence with the electric cables 2. The electric cable insertion holes 10*e* allow the electric cables 2 to be inserted thereinto. The engageable claws 10*d* are provided at an end of the electric cable insertion holes 10*e* in a direction in which the electric cables 2 are insertable. The electric cable insertion holes 10*e* are in communication with the filling spaces 10*a* and run through the housing 10 up to the other end thereof, and have the same cross-sectional shape as that of the electric cables 2. Therefore, in the state where the electric cables 2 are inserted into the electric cable insertion holes 10*e*, an outer circumferential surface of an insulating cover 21 of each electric cable 2 is in contact with a wall of the corresponding electric cable insertion hole 10*e* with substantially no space. Owing to this, the electric cable 2 is restricted to be at a prescribed position inside the housing 10.

As shown in FIG. 6, the filling spaces 10*a* and the electric cable insertion holes 10*e* have different widths from each other. The filling spaces 10*a* have a larger width than that of the electric cable insertion holes 10*e*. As a result, there is a step 10*f* between each filling space 10*a* and the corresponding electric cable insertion hole 10*e*.

As shown in FIG. 1 through FIG. 5, an end of each engageable claw 10*d* on the side of the other end of the housing 10 is a free end. Therefore, when the engageable claws 10*d* are pushed toward centers of the electric cable insertion holes 10*e* in a radial direction thereof in the state where the electric cables 2 are not in the electric cable insertion holes 10*e*, the engageable claws 10*d* are displaced toward the centers of the electric cable insertion holes 10*e* because of the flexibility of the housing 10.

The engageable claws 10*d* are each provided commonly for the plurality of electric cables 2 inserted into the electric cable insertion holes 10*e*, and each have a width which is substantially the same as the distance between the centers of the two outer electric cable insertion holes 10*e*. The engageable claws 10*d* each have an electric cable contact part 10*g* which extends in the direction in which the electric cables 2 are located side by side and contact edges of the electric cable insertion holes 10*e*, a metal cover contact part 10*h* standing perpendicularly from the electric cable contact part 10*g* and contacting an edge of the metal cover 11 on the side of the other end of the connector 1, and vertical ribs 10*i* for connecting the electric cable contact part 10*g* and the metal cover contact part 10*h* to each other.

As shown especially in FIG. 2 through FIG. 4, the electric cable contact part 10*g* has electric cable contact parts 10*j* in positional correspondence with the electric cables 2. Owing to this each engageable claw 10*d* can contact, with no gap, the electric cables 2 inserted into the electric cable insertion holes 10*e*.

A plurality of (herein, three) the vertical ribs 10*i* are provided in positional correspondence with the electric cables 2. The vertical ribs 10*i* each have an inclined part 10*k* which is inclined, from a tip thereof to the opposite end thereof, in a direction opposite to the direction in which the engageable claw 10*d* is displaceable.

The metal cover 11 includes a tube-like part 11*a* having a generally elliptical cross-section and a generally rectangular flange 11*b* standing perpendicularly from one end of the tube-like part 11*a*. The flange 11*b* has bolt holes 11*c* through which bolts 6 (see FIG. 6) are insertable. The bolt holes 11*c* are formed at four corners of the flange 11*b*.

In the connector 1, the flange 11*d* of the metal cover 11 is in contact with one of the convexed parts 10*c* of the housing 10, and thus one end of the metal cover 11 is positionally restricted. In addition, an edge of the other end of the tube-like part 11*a* of the metal cover 11 is engaged with, and stopped by, the engageable claws 10*d*, and thus the other end of the metal cover 11 is positionally restricted. In this manner, the one end and the other end of the metal cover 11 are positionally restricted by the convexed part 10*c* and the engageable claws 10*d*, so that the relative positions of the housing 10 and the metal cover 11 are restricted.

The electric cable contact parts 10*j* of the engageable claws 10*d* are in contact, with no gap, with the electric cables 2, which are positionally restricted by the electric cable insertion holes 10*e*, so that the engageable claws 10*d* are restricted from being displaced toward the centers of the electric cable insertion holes 10*e* in the radial direction. In this manner, the displacement of the engageable claws 10*d* is restricted by the electric cables 2, so that the engageable claws 10*d* are kept engaged with the metal cover 11 by the electric cables 2.

As shown in FIG. 6, the metal terminal parts 12 each include a connection terminal part 12*a*, a wire barrel 12*b* and an insulation barrel 12*c*, which are integrally formed together. The electric cables 2 are each stripped of the insulating cover 21 at the end thereof to expose conductive wires 22. In the connector 1, each insulating cover 21 at the end is pressure-contacted on the insulation barrel 12*c* by caulking, and the exposed conductive wires 22 are pressure-contacted on the wire barrel 12*b* by caulking. In this manner, the insulating covers 21 and the conductive wires 22 are pressure-contacted by caulking, so that the ends of the electric cables 2 are pressure-contacted on the metal terminal parts 12.

In the connector 1, the filling spaces 10*a* are located in positional correspondence with pressure-contact parts A (see FIG. 6) at which the ends of the electric cables 2 are pressure-contacted on the metal terminal parts 12. Owing to this, the pressure-contact parts A are accommodated in the housing 10. Each filling space 10*a* is filled with the filler 13 such that the filler 13 covers the pressure-contact part A. Materials usable as the filler 13 include, for example, an epoxy resin, an acrylic resin and silicone.

As shown in FIG. 6, in the housing 10, the filling spaces 10*a* each have substantially the same width as that of the insulating barrel 12*c*. Owing to this, the insulating barrel 12*c* is fit to the step 10*f* with no gap.

The connector 1 is used to connect the electric cables 2 for supplying electricity of a large current and a high voltage to an electric device M (see FIG. 6) such as, for example, a motor mounted on an electric vehicle. A chassis of the electric device M shown in FIG. 6 has an insertion opening Ma, and bolt holes Mb. In this case, as shown in FIG. 6, the connector 1 is inserted into the insertion opening Ma, and the bolts 6 are inserted into the bolt holes 11*c* of the metal cover 11 and the bolt holes Mb of the electric device M to tighten the connector 1 and the electric device M to each other. Thus, the electric device M and the electric cables 2 are connected to each other.

Now, steps for assembling the connector 1 and connecting the electric cables 2 to the connector 1 will be described.

Figure 7A:
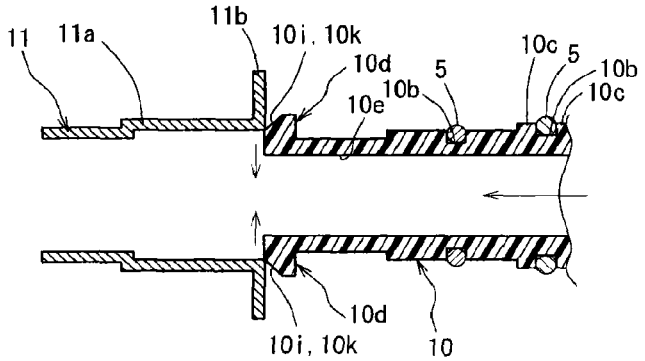
FIGS. 7A and 7B show how to assemble the connector and connect electric cables to the connector.

First as shown in FIG. 7A, the metal cover 11 is attached to the housing 10. In the step shown in FIG. 7A, the other end of the housing 10 is inserted into the metal cover 11 from the one end of the metal cover 11. In this step, when it is attempted to insert the engageable claws 10*d* located at the other end of the housing 10 into the metal cover 11, the inclined parts 10*k* of the vertical ribs 10*i* contact an edge of the one end of the metal cover 11. When it is further attempted to insert the housing 10 into the metal housing 11, the engageable claws 10*d* are pressed along the inclined parts 10*k*. As a result, as represented with the thick arrows in the figure, the engageable claws 10*d* are displaced toward the centers of the electric cable insertion holes 10*e*. Owing to this, the housing 10 is inserted into the metal cover 11.

Figure 7B:
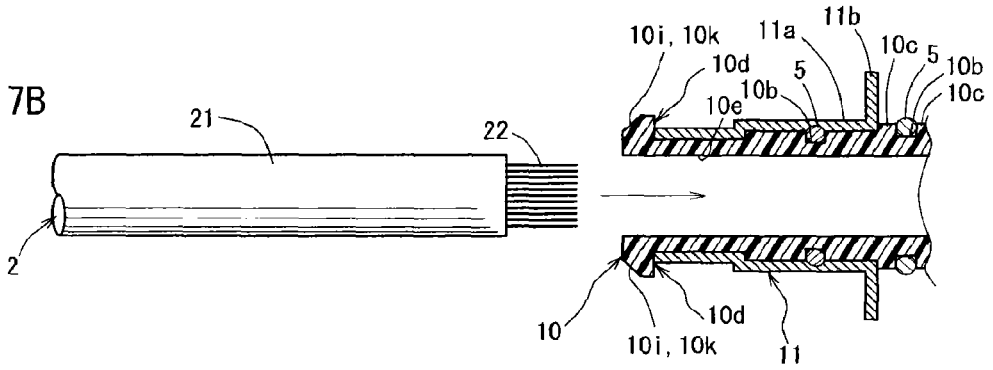

The engageable claws 10*d* inserted into the metal cover 11 reach the other end of the metal cover 11 and go beyond the edge of the other end of the metal cover 11. At this point, the engageable claws 10*d* are released from the pressing force of the metal cover 11 and returns to the original shape thereof. As a result, as shown in FIG. 7B, the engageable claws 10*d* are engaged with, and stop, the edge of the other end of the metal cover 11. The engageable claws 10*d* and the concaved part 10*c* at the one end of the housing 10 restrict the relative positions of the housing 10 and the metal cover 11. Thus, the attachment of the metal cover 11 to the housing 10 is finished.

Next, in the step shown in FIG. 7B, each electric cable 2 stripped of the insulating cover 21 to expose the conductive wires 22 is inserted into the electric cable insertion hole 10*e* of the housing 10. In this step, as shown in FIG. 7B, the end of the electric cable 2 is inserted into the electric cable insertion hole 10*e* from the other end of the housing 10. The electric cables 2 are inserted into the electric cable insertion holes 10*e* of the housing 10 in this manner, so that the displacement of the engageable claws 10*d* is restricted by the electric cables 2. As a result, the engageable claws 10*d* are kept engaged with the metal cover 11 by the electric cables 2.

Figure 8A:
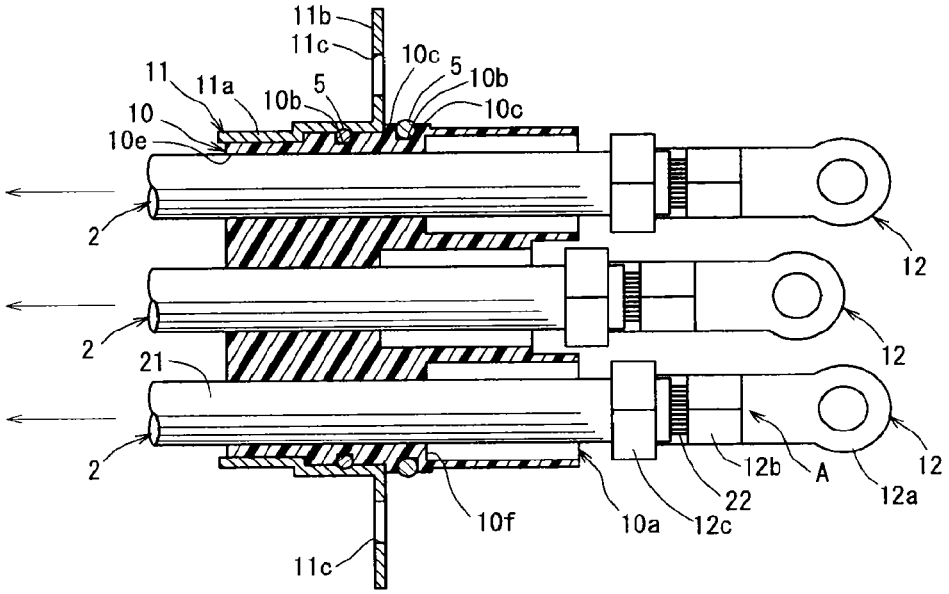
FIGS. 8 and 8B show how to assemble the connector and connect the electric cables to the connector.

Next, in the step shown in FIG. 8A, the ends of the electric cables 2 are pressure-contacted on the metal terminal parts 12. In this step, as shown in FIG. 8A, the ends of the electric cables 2 inserted into the electric cable insertion holes 10*e* are pulled outside from the one end of the housing 10, and the conductive wires 22 at the ends and the insulating covers 21 are respectively pressure-contacted on the wire barrels 12*b* and the insulation barrels 12*c* by caulking.

After the electric cables 2 are pressure-contacted on the metal terminal parts 12, the electric cables 2 are pulled in a direction toward the other end of the connector 1 as represented with the thick arrows until the insulation barrels 12*c* contact the steps 10*f* of the housing 10. The insulation barrels 12*c* are put into contact with the steps 10*f*, so that the position of the electric cables 2 in the direction in which the electric cables 2 are insertable is restricted, and also the positions of the pressure-contact parts A in the filling spaces 10*a* of the housing 10 are determined.

Figure 8B:
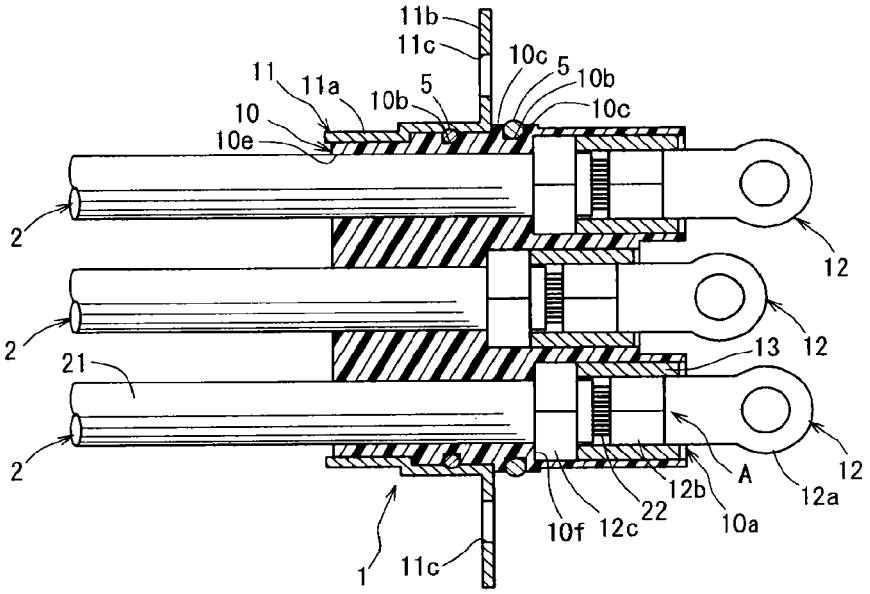

In the step shown in FIG. 8B, the filling spaces 10*a* are filled with the filler 13 such that the filler 13 covers the pressure-contact parts A. In this manner, the steps shown in FIGS. 7A-7B and FIGS. 8A-8B are performed, and thus the connector 1 having the ends of the electric cables 2 pressure-contacted on the metal terminal parts 12 is completed.

As described above, in this embodiment, the connector 1 includes the tube-like metal cover 11 for covering the housing 10. In addition, the engageable claws 10*d* which are restricted, by the electric cables 2 inserted into the electric cable insertion holes 10*e*, from being displaced restrict the relative positions of the housing 10 and the metal cover 11. Thus, the connector 1 can be assembled with certainty with a simple structure while the number of components thereof is reduced.

This will be described in more detail. The metal cover 11, which is tube-like, can be formed of a single component. This decreases the number of components of the connector 1. In addition, the electric cables 2 inserted into the electric cable insertion holes 10*e* are used to restrict the engageable claws 10*d* from being displaced. Therefore, the relative positions of the housing 10 and the metal cover 11 are restricted with no use of any additional bolt or the like. This decreases the number of components of the connector 1, and also makes the troublesome work of bolt tightening or the like unnecessary. Therefore, the connector 1 can be assembled with certainty with a simple structure.

The electric cable insertion holes 10*e* are put into contact with the outer circumferential surfaces of the insulating covers 21 of the electric cables 2, and the electric cables 2 are in contact with the walls of the electric cable insertion holes 10*e* with substantially no space. This allows the electric cables 2 to restrict, with more certainty, the engageable claws 10*d* from being displaced.

The housing 10 is formed of a resin. The engageable claws 10*d* integrally formed in the housing 10 are located at the ends of the electric cable insertion holes 10*e* from which the electric cables 2 are inserted, and are displaceable toward the centers of the electric cable insertion holes 10*e* in the radial direction. Owing to this, the edge of the other end of the metal cover 11 can be put into engagement with, and stopped by, the engageable claws 10*d* easily and with certainty merely by a work of pushing the engageable claws 10*d* into the metal cover 11 while the engageable claws 10*d* are displaced toward the centers of the electric cable insertion holes 10*e*.

This will be described in more detail. The housing 10 is inserted into the metal cover 11 in order to attach the metal cover 11 to the housing 10. In this step, the engageable claws 10*d* are pushed into the metal cover 11 while being displaced toward the centers of the electric cable insertion holes 10*e* in the radial direction. In this manner, the housing 10 is inserted into the metal cover 11. The engageable claws 10*d* inserted into the metal cover 11 go beyond the edge of the other end of the metal cover 11. At this point, the engageable claws 10*d* are released from the pressing force of the metal cover 11 and returns to the original shape thereof. As a result, the edge of the other end of the metal cover 11 is engaged with, and stopped by, the engageable claws 10*d*. Then, the electric cables 2 are inserted into the electric cable insertion holes 10*e* while the edge of the other end of the metal cover 11 is engaged with, and stopped by, the engageable claws 10*d*, so that the engageable claws 10*e* are put into a locked state in which the engageable claws 10*e* are restricted from being displaced.

The engageable claws 10*d* have the inclined parts 10*k* which are inclined, from a tip thereof to the opposite end thereof, in a direction opposite to the direction in which the engageable claw 10*d* is displaceable. Owing to this, during the work of inserting the housing 10 into the metal cover 11, the engageable claws 10*d* are pressed along the inclined parts 10*k* without any external force being applied toward the centers of the electric cable insertion holes 10*e* in the radial direction. As a result, the engageable claws 10*d* are displaced toward the centers of the electric cable insertion holes 10*e*. This simplifies the work of attaching the metal cover 11 to the housing 10.

The engageable claws 10*d* each have a width which is substantially the same as the distance between the centers of the two outer electric cable insertion holes 10*e*. This allows the edge of the other end of the metal cover 11 to be stopped over a larger width. Therefore, the relative positions of the housing 10 and the metal cover 11 are restricted more stably. The vertical ribs 10*i* for connecting the electric cable contact part 10*g* and the metal cover contact part 10*h* to each other are provided in positional correspondence with the electric cables 2. Owing to the vertical ribs 10*i*, the engageable claws 10*d* can firmly receive the pressing force applied from the electric cables 2 and the edge of the other end of the metal cover 11; namely, the engageable claws 10*d* is made more durable.

The pair of engageable claws 10*d* are provided so as to hold the electric cables 2 therebetween. Owing to this, the metal cover 11 can be stopped by the engageable claws 10*d* at symmetrical positions. This allows the relative positions of the housing 10 and the metal cover 11 to be restricted with good balance.

In this embodiment, the connector 1 includes the electric cable insertion holes 10*e*, each defined by the wall with which the outer circumferential surface of the insulating cover 21 of each electric cable 2 is put into contact, and also includes the filling spaces 10*a* in communication with the electric cable insertion holes 10*e*. In addition, the filling spaces 10*a* are filled with the filler 13 such that the filler 13 covers the pressure-contact parts A. These arrangements simplify the structure of the connector 1.

This will be described in more detail. Since the filling spaces 10*a* accommodating the pressure-contact parts A are filled with the filler 13, the pressure-contact parts A are covered with certainty with no use of any molding method. In addition, the electric cable insertion holes 10*e* are put into contact with the outer circumferential surfaces of the insulating covers 21, and the electric cables 2 are in contact with the walls of the electric cable insertion holes 10*e* with substantially no gap. This restricts the positions of the electric cables 2 inserted into the electric cable insertion holes 10*e*, and thus restricts the positions of the pressure-contact parts A in the filling spaces 10*a*. In this case, the positions of the pressure-contact parts A are restricted with no need of any special component. This simplifies the structure of the connector 1.

The steps 10*f* are each formed between the filling space 10*a* and the electric cable insertion hole 10*e*, in correspondence with the difference between the width of the electric cable 2 and the width of the pressure-contact part A (herein, the width of the insulation barrel 12*c*, which has the largest width). Owing to this, the step 10*f*, formed because of the width difference between the electric cable 2 and the pressure-contact part A, is usable to determine the position of the pressure-contact part A in the direction in which the electric cable 2 is insertable, with no need of any special component. Therefore, the position of the pressure-contact part A in the filling space 10*a* is restricted with more certainty while the structure of the connector 1 is simplified.

The housing 10 has the filling spaces 10*a*, which are provided in correspondence with the plurality of electric cable insertion holes 10*e* and are separate from each other. Owing to this, the pressure-contact parts A are covered with the filler 13 with certainty. This will be described in more detail. For example, it is conceivable to form one common filling space for accommodating the plurality of pressure-contact parts A. However, such a filling space has a complicated and enlarged structure, and thus involves an undesirable possibility that air bubbles are formed in a part of the filling space during the work of filling the filling space with the filler 13. By contrast, in the above-described structure in which the filling spaces 10 are formed separately in correspondence with the electric cable insertion holes 10*e*, each filling space 10*a* is simplified in shape and decreased in capacity. Therefore, the pressure-contact parts A are covered with the filler 13 with certainty with no air bubble being formed in the filling spaces 10*a*.

In the above-described embodiment, the engageable claws 10*d* are formed integrally in the housing 10 in order to restrict the relative positions of the housing 10 and the metal cover 11. The present invention is not limited to such a structure. For example, either one of the housing 10 and the metal cover 11 may have a groove or a convexed part, whereas the other of the housing 10 and the metal cover 11 may have a convexed part or a groove engageable with the groove or the convexed part.

In the above-described embodiment, the pair of engageable claws 10*d* are provided so as to hold the electric cables 2 therebetween. The present invention is not limited to such a structure. For example, a pair of engageable claws (engageable members) facing each other in a direction perpendicular to the direction in which the engageable claws 10*d* face each other may be additionally provided. Alternatively, a plurality of engageable members (engageable claws) may be provided on the edge of the other end of the housing 10 at a prescribed interval in a circumferential direction thereof, with no limitation on the direction in which the engageable members are directed.

Figure 9A:
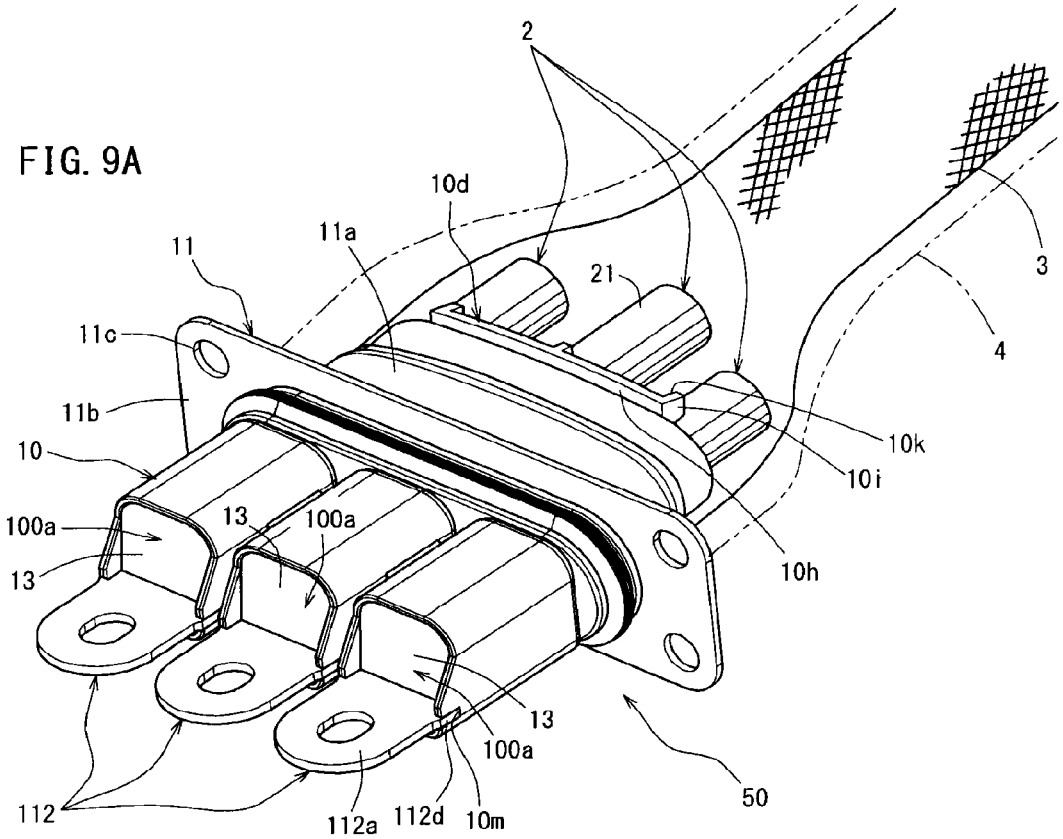
FIGS. 9A and 9B provide isometric views of a connector in another embodiment according to the present invention.
Figure 9B:
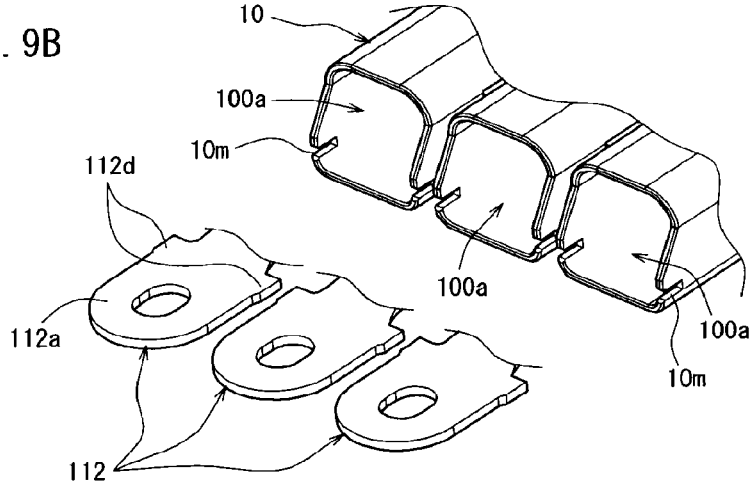
Figure 10:
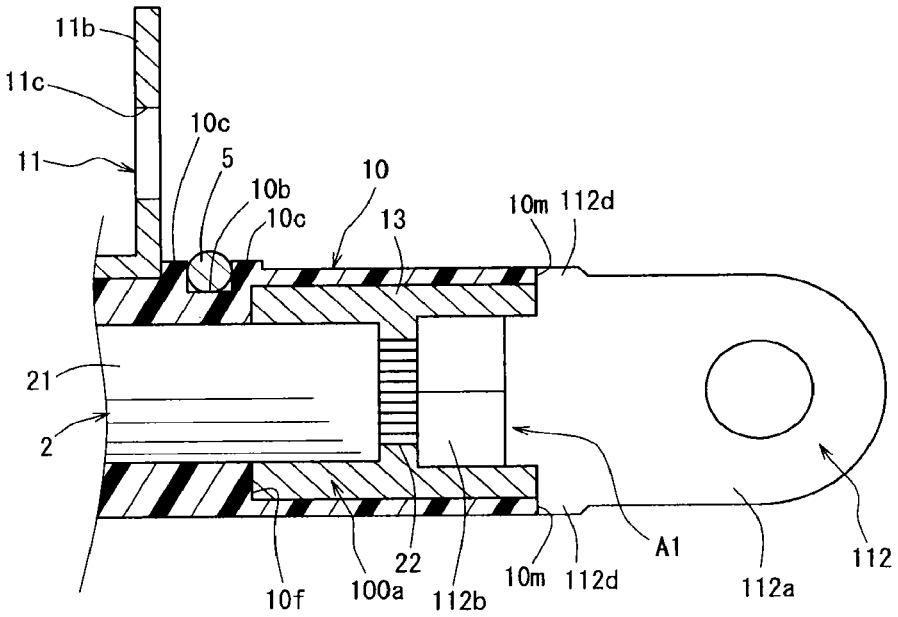
FIG. 10 is a horizontal cross-sectional view of the connector in FIGS. 9A and 9B that shows a pressure-contact part and the vicinity thereof.

FIGS. 9A and 9B provide isometric views of a connector 50 in another embodiment according to the present invention. FIG. 10 is a horizontal cross-sectional view of the connector 50 in FIGS. 9A and 9B. In more detail, FIG. 9A is an isometric view of the connector 50 as seen from one of two ends thereof, and FIG. 9B is an exploded isometric view of the connector 50 that shows filling spaces 100*a* and metal terminal parts 112 of the housing 10. FIG. 10 is a horizontal cross-sectional view of the connector 50 that shows a pressure-contact part A1 and the vicinity thereof. Elements substantially identical to those of the above-described embodiment shown in FIG. 1 through FIGS. 8A-8B bear identical reference signs thereto in FIGS. 9A-9B and FIG. 10, and the descriptions thereof will be omitted. The three pressure-contact parts A1 have generally the same structure as each other, and thus FIG. 10 shows one of the three pressure-contact parts A1 for the sake of convenience.

As shown in FIG. 9A, FIG. 9B and FIG. 10, the connector 50 in this embodiment includes the metal terminal parts 112. The metal terminal parts 112 each include a connection terminal part 112*a* and insertion pieces 112*d* protruding from the connection terminal part 112*a* laterally, namely, perpendicularly to the direction in which the electric cables 2 are insertable. The housing 10 has holding grooves 10*m* into which the insertion pieces 112*d* are insertable. The holding grooves 10*m* are each a slit formed in a part of a lateral side wall of the corresponding filling space 100*a*. The slit extends toward the other end of the housing 10.

The metal terminal parts 112 include wire barrels 112*b* but do not include parts corresponding to the insulation barrels 12*c* unlike the metal terminal parts 12 in the above-described embodiment shown in FIG. 1 through FIGS. 8A-8B. In the connector 50, the conductive wires 22 are pressure-contacted on the wire barrels 112*b* by caulking. Thus, the ends of the electric cables 2 are pressure-contacted on the metal terminal parts 112.

In this embodiment, as shown in FIG. 9A and FIG. 10, the insertion pieces 112*d* of the metal terminal parts 112 are inserted into the holding grooves 10*m* of the housing 10. Owing to this, even when, for example, the metal terminal parts 112 are vibrated while a vehicle on which the connector 50 is mounted is running, the filler 13 is prevented from being delaminated from the housing 10, the electric cables 2 or the metal terminal parts 112 by the vibration. Also even when, for example, the housing 10 is vibrated while the vehicle is running, the filler 13 is prevented from being delaminated from the housing 10, the electric cables 2 or the metal terminal parts 112 by the vibration.

In the above-described embodiment shown in FIG. 1 through FIGS. 8A-8*b*, the insulation barrels 12*c* included in the metal terminal parts 12 contact and fit the steps 10*f* with substantially no gap, so that the positions of the pressure-contact parts A of the ends of the electric cables 2 and the metal terminal parts 12 in the filling spaces 10*a* are determined. In this embodiment, as described above, the insertion pieces 112*d* are inserted into the holding grooves 10*m*. Owing to this, the positions of the pressure-contact parts A1 of the ends of the electric cables 2 and the metal terminal parts 12 in the filling spaces 100*a* can be determined even though the metal terminal parts 112 do not have the parts corresponding to the insulation barrels 12*c*.

REFERENCE SIGNS LIST

1, 50 . . . Connector
2 . . . Electric cable
10 . . . Housing
10, 100*a* . . . Filling space
10*e* . . . Electric cable insertion hole
10*f* . . . Step
12, 112 . . . Metal terminal part
13 . . . Filler
21 . . . Insulating cover
A, A1 . . . Pressure-contact part M . . . Electric device
Ma . . . Insertion opening

The invention claimed is:

1. A connector for connecting an electric cable to an electric device having an insertion opening provided for electric cable connection, the connector comprising:

a plurality of metal terminal parts, on each of the metal terminal parts having an insulating cover and conductive wires positioned at an end of the electric cable that are pressure-contacted, the electric cable being formed by covering the conductive wires by the insulating cover except for an end of the conductive wires, the end of the conductive wires being exposed; and a housing for accommodating pressure-contact parts of the ends of the electric cables and the metal terminal parts, wherein each of the pressure-contact parts is formed by pressure-contacting and caulking the insulating cover using an insulation barrel of the metal terminal part, and by pressure-contacting and caulking an exposed area of the conductive wires using a wire barrel of the metal terminal part, the insulation barrel on the insulating cover is wider than the electric cable in a width direction, the electric cable extending in a longitudinal direction perpendicular to the width direction, the housing includes a plurality of electric cable insertion holes allowing a plurality of the electric cables to be inserted thereinto, the housing also includes a plurality of filling spaces separate from each other and in communication with each of the electric cable insertion holes respectively, each of the filling spaces receives the corresponding pressure-contact part therein and a connection part of the metal terminal part being extended outwardly from the filling space, each of the electric cable insertion holes has a width such that an outer circumferential surface of the insulating cover of the electric cable contacts with an inner wall thereof, each of the filling spaces has a width in the width direction larger than a width of each of the electric cable insertion holes in the width direction, and substantially identical to a width of the insulation barrel in the width direction, a plurality of steps are formed between each of the electric cable insertion holes and the filling spaces, each of the steps corresponding to a difference between a width of the electric cable and the width of the insulation barrel, and each of the filling spaces is filled with a filler such that the filler covers the pressure-contact part.

2. A connector connection structure, comprising:

the connector according to claim 1; and the insertion opening of the electric device;

wherein the connector is inserted into the insertion opening to connect the electric device and the electric cable to each other.

* * * * *